United States Patent [19]

Rugh et al.

[11] Patent Number: 4,660,404

[45] Date of Patent: Apr. 28, 1987

[54] DIE MANIPULATOR

[75] Inventors: Clyde J. Rugh; John L. King, Jr.; Francis M. Tuttle, all of Owosso; William E. Jones, Durand, all of Mich.

[73] Assignee: MWA Company, Owosso, Mich.

[21] Appl. No.: 783,078

[22] Filed: Oct. 2, 1985

Related U.S. Application Data

[63] Continuation-in-part of Ser. No. 763,540, Aug. 8, 1985, which is a continuation-in-part of Ser. No. 725,934, Apr. 22, 1985.

[51] Int. Cl.[4] ..... B21J 13/12

[52] U.S. Cl. ..... 72/446; 72/448; 414/783; 414/774; 414/777; 414/778

[58] Field of Search ..... 414/783, 774, 777, 778, 414/779, 759; 72/446, 448

[56] References Cited

U.S. PATENT DOCUMENTS

| | | | |
|---|---|---|---|
| 3,011,657 | 12/1961 | Schutze et al. | 414/759 |
| 3,259,992 | 7/1966 | Bonwit et al. | 414/783 |
| 3,427,855 | 2/1969 | Michelson | 72/448 |
| 3,780,882 | 12/1973 | Wagner | 414/759 |
| 4,019,639 | 4/1977 | Stobb | 414/759 |
| 4,533,291 | 8/1985 | Nishida | 414/774 |

*Primary Examiner*—Robert L. Spruill
*Assistant Examiner*—David B. Jones
*Attorney, Agent, or Firm*—Barnes, Kisselle, Raisch, Choate, Whittemore & Hulbert

[57] ABSTRACT

Apparatus for manipulating the upper and lower dies of a die set comprising first and second fixtures mounted in laterally spaced relation for movement toward and away from each other. The first fixture has a mechanism providing a die-supporting surface and is in the form of a cradle rockable between a loading position in which its die-supporting surface is generally horizontal and a transfer position in which its die-supporting surface is generally upright and faces the second fixture. The second fixture has a die-supporting surface and also is in the form of a cradle rockable between a transfer position in which its die-supporting surface is generally upright and faces the first fixture and a position in which its die-supporting surface is generally horizontal. Clamps are provided to clamp the lower die of a die set to the die-supporting surface of the first fixture and for clamping the upper die to the die-supporting surface of the second fixture. With the two dies releasably secured together, the lower die is clamped to the die-supporting surface of the first fixture when the first fixture is in its loading position. The fixtures are moved relatively toward one other to transfer and clamp the upper die to the die-supporting surface of the second fixture, after which the two dies are released from one another so that they may be separated by movement of the fixtures away from one another to positions such that the dies may be inspected or cleaned. To repair the dies, the fixtures are rotated to positions in which the die-supporting surfaces are generally horizontal.

12 Claims, 16 Drawing Figures

FIG. 12
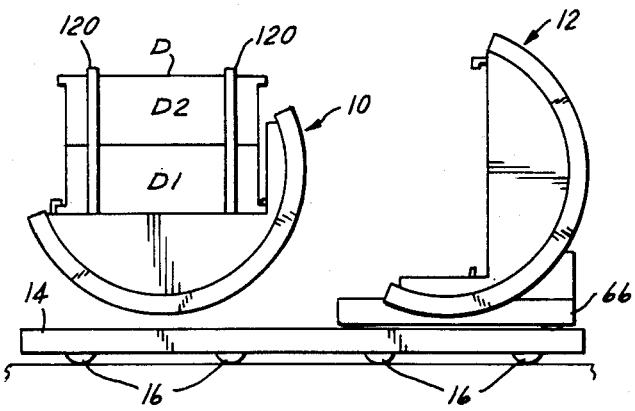
FIG. 14
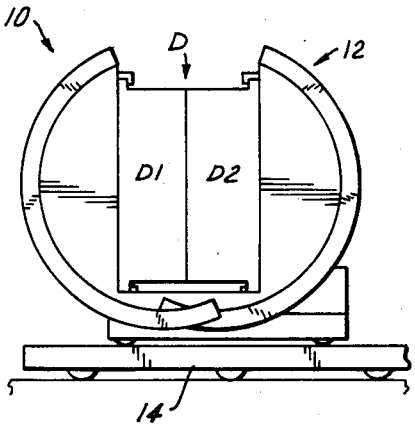
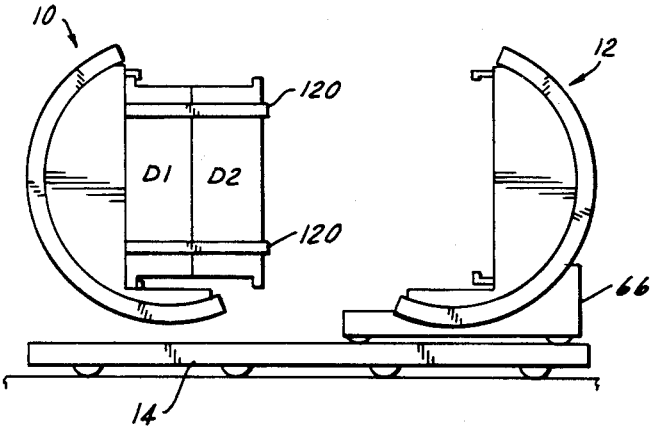
FIG. 13
FIG. 15
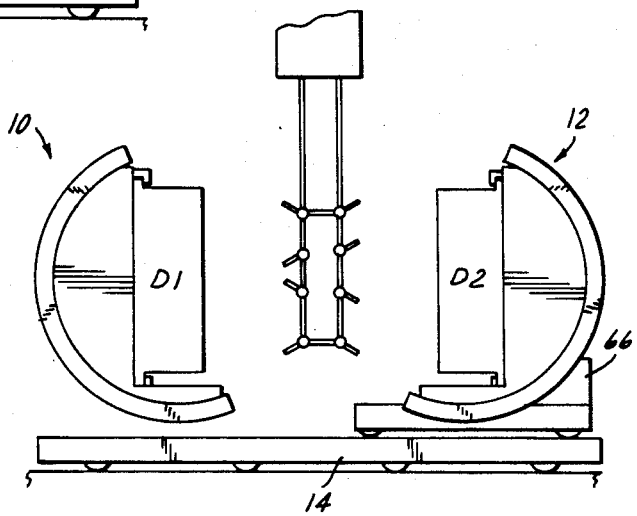
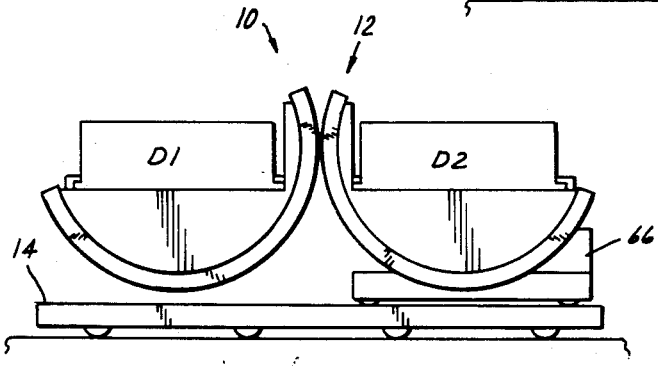
FIG. 16

DIE MANIPULATOR

This invention relates generally to apparatus for manipulating a workpiece, and refers more particularly to apparatus for manipulating the upper and lower dies of a die set.

REFERENCE TO RELATED APPLICATIONS

This application is a continuation-in-part of our prior copending application Ser. No. 763,540 filed Aug. 8, 1985, which in turn is a continuation-in-part of our prior copending application Ser. No. 725,934 filed Apr. 22, 1985.

SUMMARY OF THE INVENTION

From time to time, it is necessary to carry out inspection, cleaning, repair and/or maintenance procedures on dies of the type used to shape large metal stampings such, for example, as those employed in the automotive industry. In order to inspect or clean the dies of a die set, the dies must be separated and for the sake of convenience should be tipped so that their contoured surfaces are upright. Repair and maintenace procedures are carried out most conveniently when the contoured surfaces of both dies face upwardly. The apparatus of this invention is designed particularly for manipulating the dies of a die set so that they may be inspected, cleaned, repaired and/or maintained.

In accordance with a specific embodiment of the invention about to be described, the manipulator apparatus comprises first and second fixtures mounted in laterally spaced relation for movement toward and away from each other. The first fixture has a die-supporting surface and can be moved from a loading position to a transfer position. The second fixture also has a die-supporting surface. The upper and lower dies are secured together and are clamped to the die-supporting surface of the first fixture when in its loading position. Means are provided to rock the first fixture to its transfer position and to relatively move the fixtures toward one another for transfer of the upper die to the die-supporting surface of the second fixture. The upper die is then clamped to the die-supporting surface of the second fixture, the two dies are released from each other, and the fixtures are moved apart so that the dies may be inspected and/or cleaned.

More specifically, both fixtures are preferably in the form of cradles, each being rockable between positions in which its die-supporting surface is generally horizontal and in which its die-supporting surface is generally upright. Transfer of the upper die to the second fixture occurs when both die-supporting surfaces are upright, so that when the fixtures are moved apart the dies are in positions such that they can be conveniently inspected or cleaned. The fixtures may be rocked to positions in which the die-supporting surfaces are generally horizontal so that the dies are oriented conveniently for repair and maintenance procedures.

These and other objects of the invention will become more apparent as the following description proceeds, especially when considered in conjunction with the accompanying drawings.

DESCRIPTION OF THE DRAWINGS

FIGS. 12–16 are schematic views showing the manipulator apparatus in several positions as it carries out the various steps in manipulating the dies.

DETAILED DESCRIPTION

Figure 1:
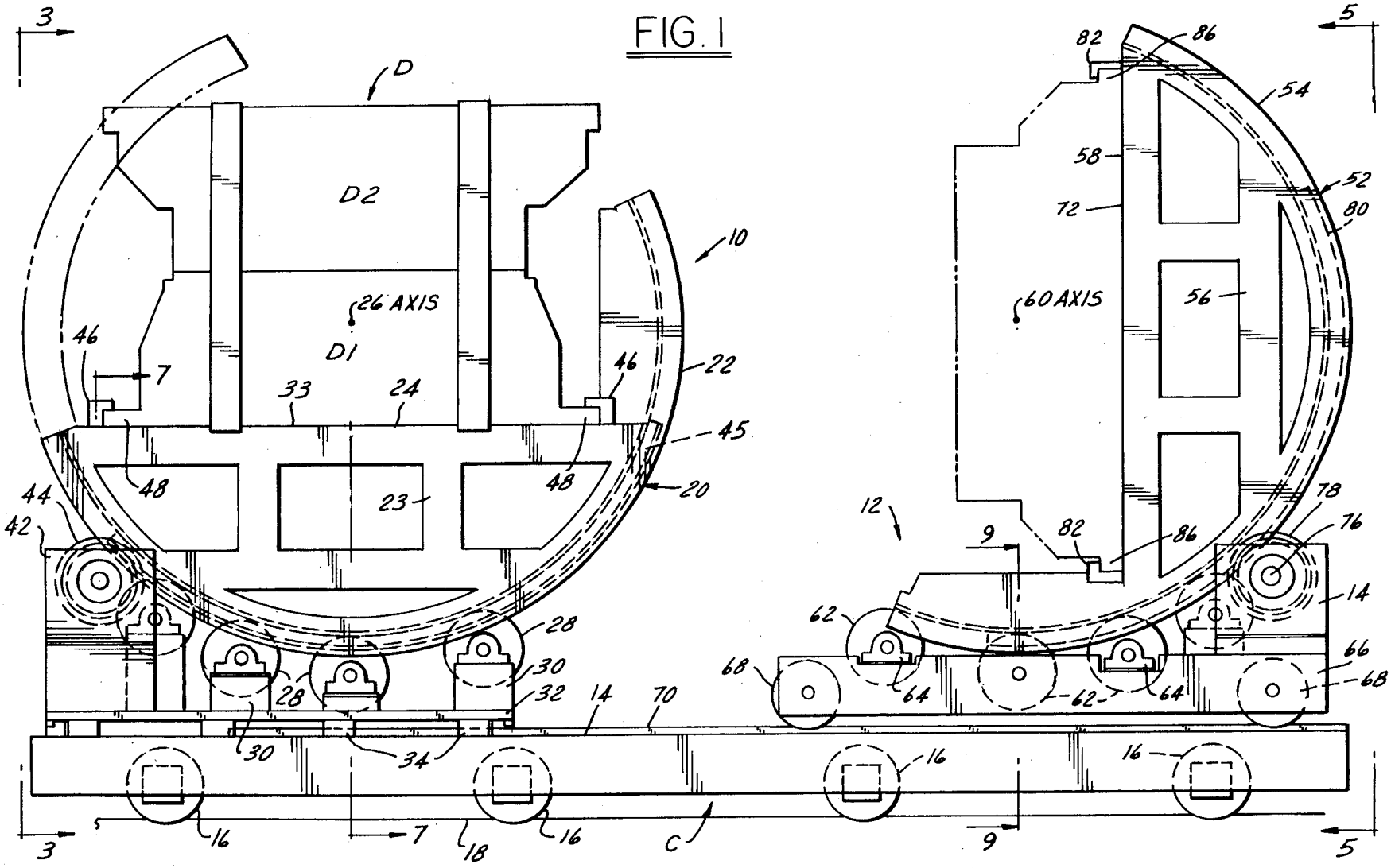
FIG. 1 is a side elevational view of apparatus constructed in accordance with our invention.
Figure 2:
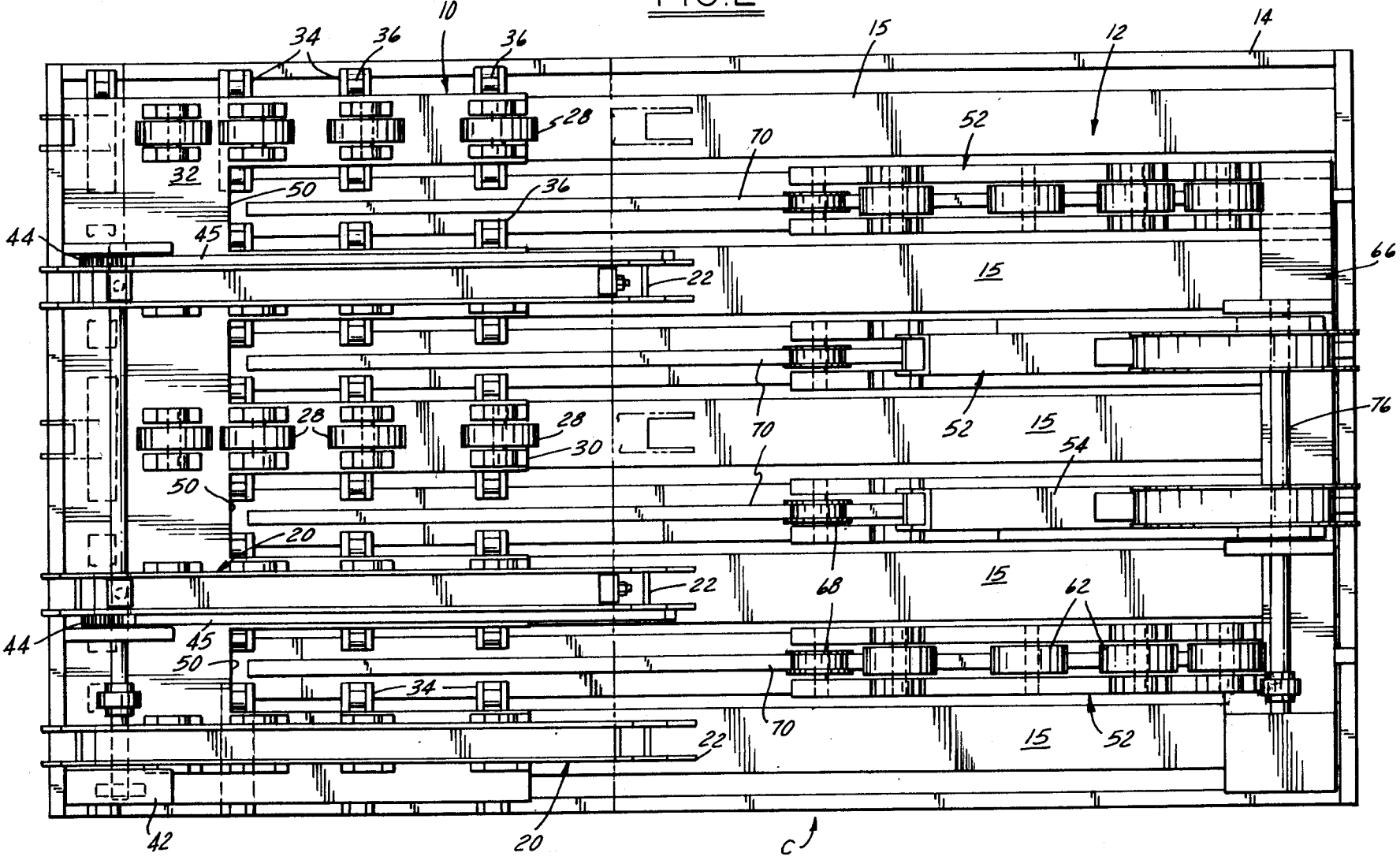
FIG. 2 is a top plan view of the apparatus shown in FIG. 1.

Referring now more particularly to the drawings and especially to FIGS. 1–7 thereof, the manipulator apparatus comprises fixtures 10 and 12 mounted in spaced apart relation on a cart C. The fixtures are for handling the dies D1 and D2 of a die set D. The cart has a horizontal platform 14 comprising longitudinally extending frame members 15 and mounted on wheels 16 which run on tracks 18.

The fixture 10 is in the form of a cradle composed of laterally spaced fixture sections 20 each having an arcuate channel 22 and a frame structure 23 inside the channel provided with a die-supporting frame member 24. The centers of the channels are aligned on an axis 26 which extends at right angles to the path of cart movement.

Each channel 22 is supported for rocking or arcuate movement about the axis 26 by rollers 28. Rollers 28 are mounted for free rotation on roller supports 30 carried by a horizontal mounting plate 32. The fixture sections 20 are connected together by structural elements 31 so that their die-supporting frame members 24 occupy a common plane providing a die-supporting surface 33.

The mounting plate is supported on the platform 14 of the cart by support bars 34. These support bars have rollers 36 on the top surface serving as anti-friction members. Rollers 36 have their axes extending parallel to the cart path to facilitate a transverse adjustment of fixture 10. The rollers 36 are mounted on the support bars 34 by means permitting them to be lowered so that after the fixture is adjusted transversely, the rollers will be lowered to transfer the weight of the plate 32 to the support bars 34. The rollers of each support bar may, for example, be mounted for free rotation on a common support rail 37 carried by the bar 34 which may be raised or lowered as desired to raise and lower the rollers by air under pressure admitted within the bar 34 beneath the rail. Support bars with rollers capable of thus being raised or lowered to and from a supporting position are commonly known as air rails and are readily available in the industry.

Figure 4:
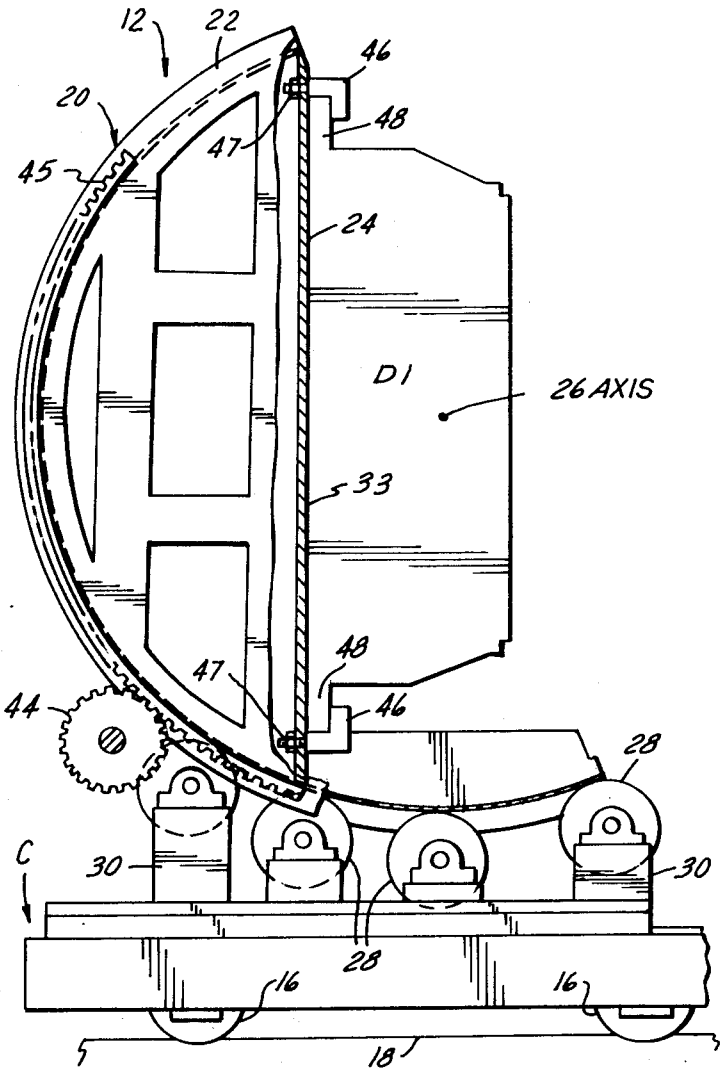
FIG. 4 is a sectional view taken on the line 4—4 in FIG. 3.
Figure 3:
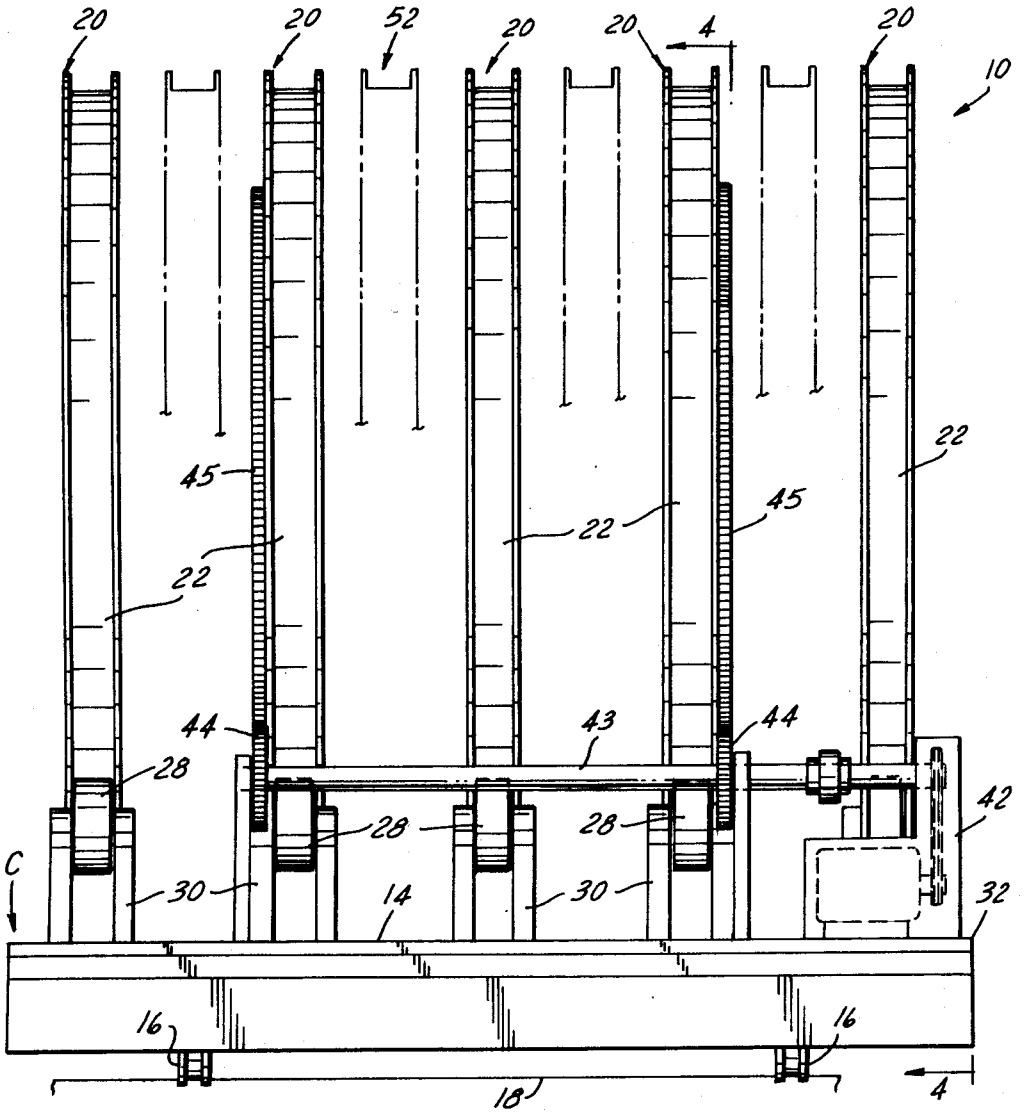
FIG. 3 is a view taken on the line 3—3 in FIG. 1.

The fixture 10 can be rocked between the position of FIG. 1 in which its die-supporting surface 33 is generally horizontal and the position of FIG. 4 in which its die-supporting surface is generally vertical. For thus rocking the fixture 10, there is a motor 42 mounted on plate 32. The output shaft of the motor drives a gear shaft 43 which has gears 44 meshing with racks 45 on certain of the fixture sections 20.

The frame member 24 of each fixture section has a pair of clamps 46 secured thereto by means of nuts 47 threaded on shanks projecting from the clamps. The lower die D1 has laterally outwardly extending flanges 48 over which clamps 45 engage to secure the die D1 in fixed position on the die-supporting surface 33 as shown in FIGS. 1 and 4.

The mounting plate 32 is recessed at 50 between the fixture sections 20 to clear the sections of fixture 12 when the two fixtures are moved relatively toward one another as more fully described hereinafter.

The fixture 12 is in the form of a cradle composed of laterally spaced fixture sections 52 each having an arcuate channel 54 and a frame structure 56 inside the channel provided with a die-supporting frame member 58. The centers of the channels are aligned on an axis 60 which extends parallel to the axis 26 of the fixture 10.

Each channel 54 is supported for rocking or arcuate movement about the axis 60 by rollers 62. Rollers 62 are mounted for free rotation on roller supports 64 mounted on a carriage 66. The carriage has wheels 68 which run on parallel tracks 70 on the top surface of the platform 14 of the cart C that extend into the recesses 50 of mounting plate 32. Tracks 70 are perpendicular to the axes 26 and 60. The fixture sections 52 are connected together by structural elements similar to the structural elements 31 connecting the fixture sections 20 of fixture 10 in a manner such that their die-supporting frame members 58 occupy a common plane providing the die-supporting surface 72.

The fixture 12 can be rocked between the position of FIG. 1 in which its die-supporting surface 72 is generally vertical and a position in which its die-supporting surface is generally horizontal. For thus rocking the fixture 12, there is a motor 74 mounted on the carriage 66. The output shaft of the motor drives a gear shaft 76 which has gears 78 meshing with racks 80 on certain of the fixture sections 52.

Figure 6:
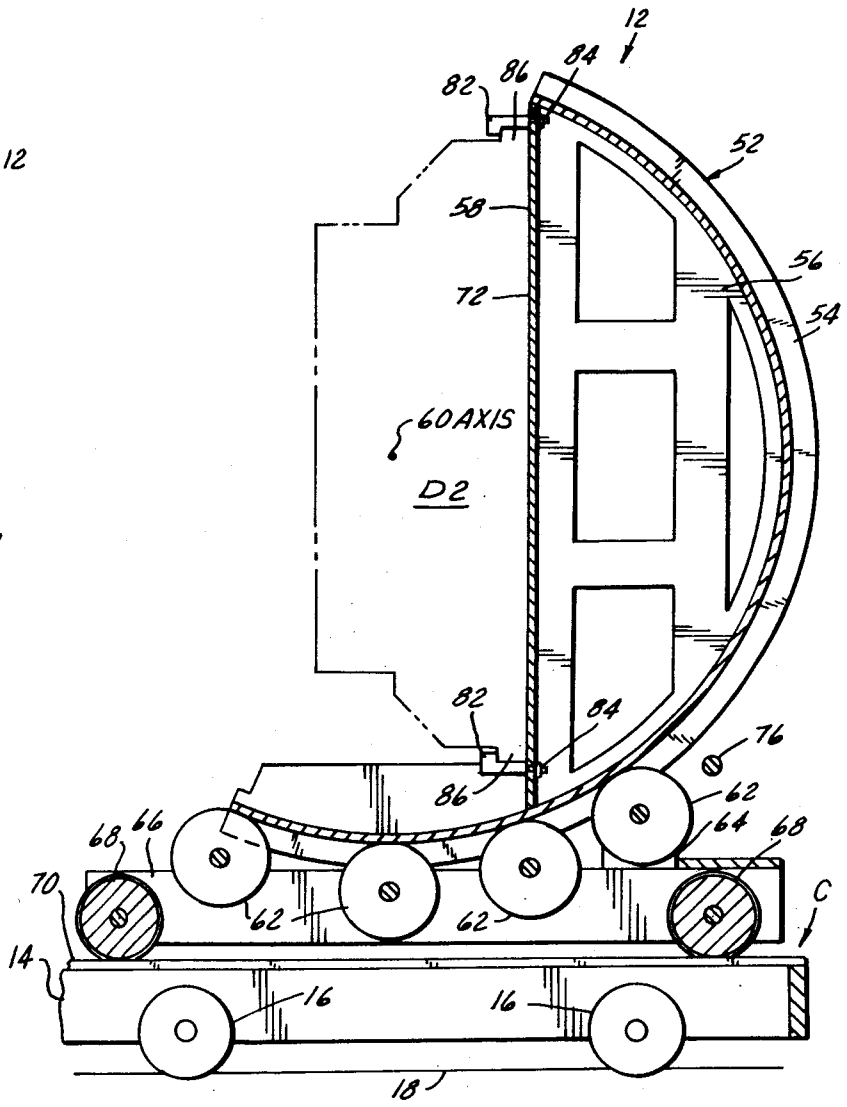
FIG. 6 is a sectional view taken on the line 6—6 in FIG. 5.
Figure 5:
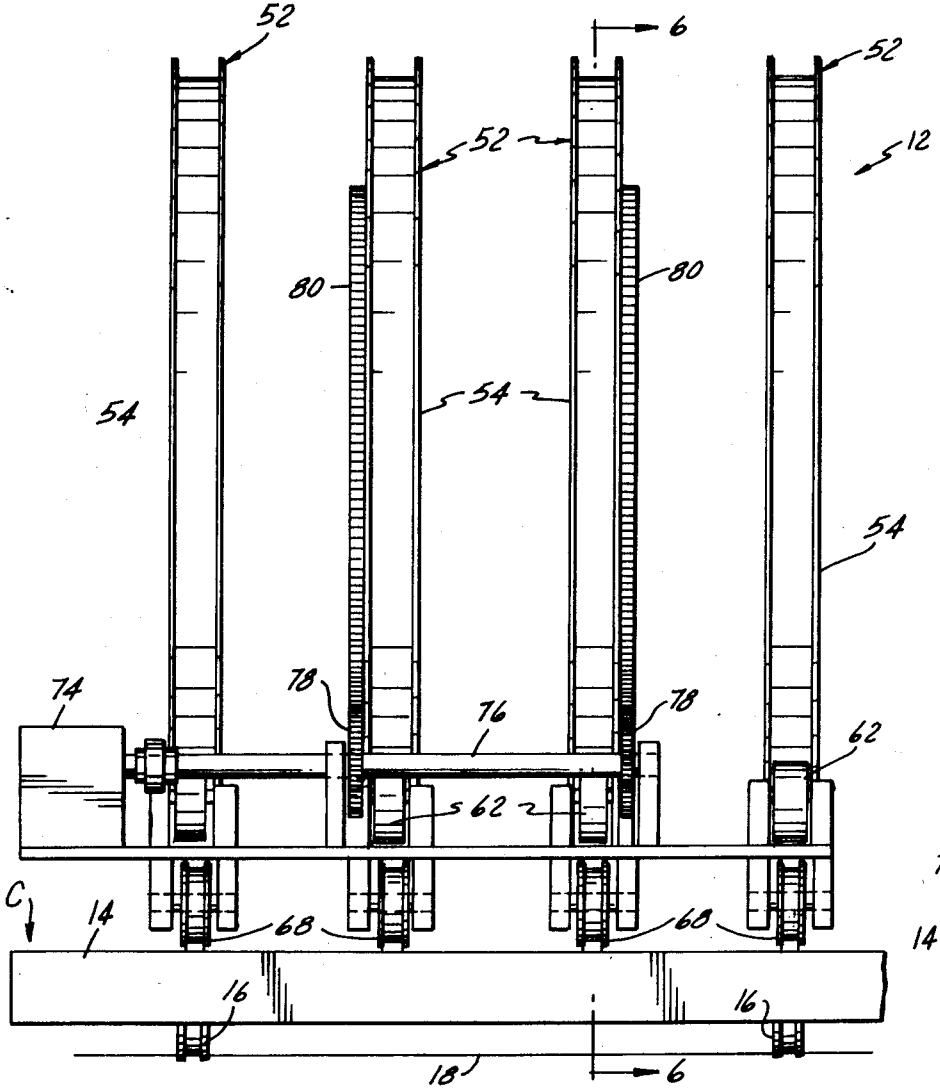
FIG. 5 is a view taken on the line 5—5 in FIG. 1.
Figure 7:
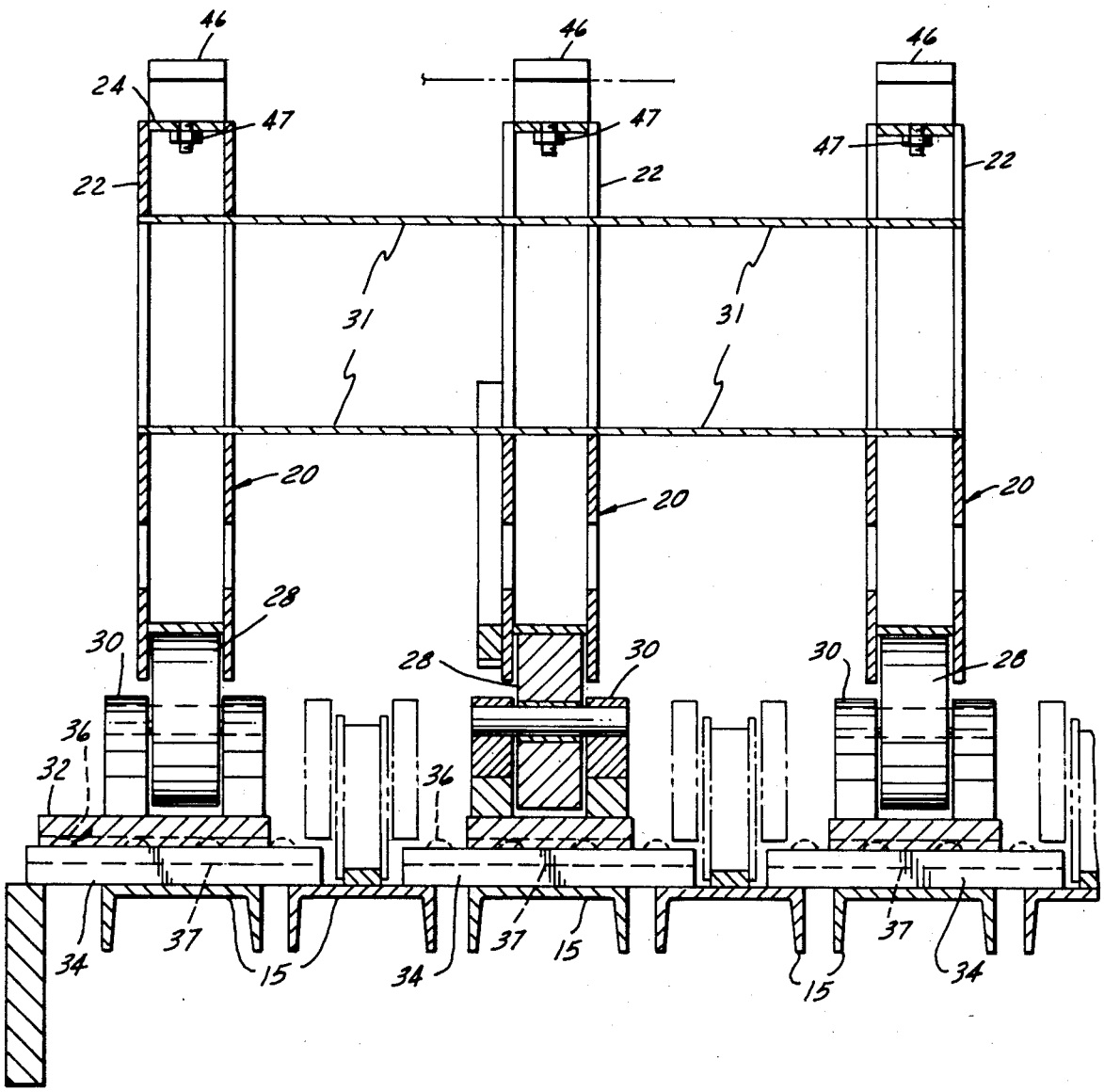
FIG. 7 is a fragmentary sectional view taken on the line 7—7 in FIG. 1.

The frame member 58 of each fixture section 52 has a pair of clamps 82 secured thereto by means of nuts 84 threaded on shanks projecting from the clamps. The upper die D2 has laterally outwardly extending flanges 86 over which the clamps 82 engage to secure the die D2 in fixed position on the die-supporting surface 72 as shown in FIGS. 1 and 6.

The carriage 66 for fixture 12 can be moved along tracks 70 in a direction away from fixture 10 to the position of FIGS. 1, 12, 13, 15 and 16, and can be moved along tracks 70 in the opposite direction toward fixture 10 to the position of FIG. 14. Such movement of the fixture carriage 66 can be carried out manually or by a suitable power source (not shown). The fixture sections 52 of fixture 12 are offset relative to the fixture sections 20 of fixture 10 so that when the fixture 12 is moved toward the fixture 10 to the FIG. 14 position the fixture sections of one fixture will enter the spaces between the fixture sections of the other fixture without interference. The carriage 66 is recessed in the spaces between fixture sections 52 so as not to interfere with any part of fixture 10 or of the mounting plate 32, supporting rollers 28 or roller supports 30 of fixture 10.

Figure 8:
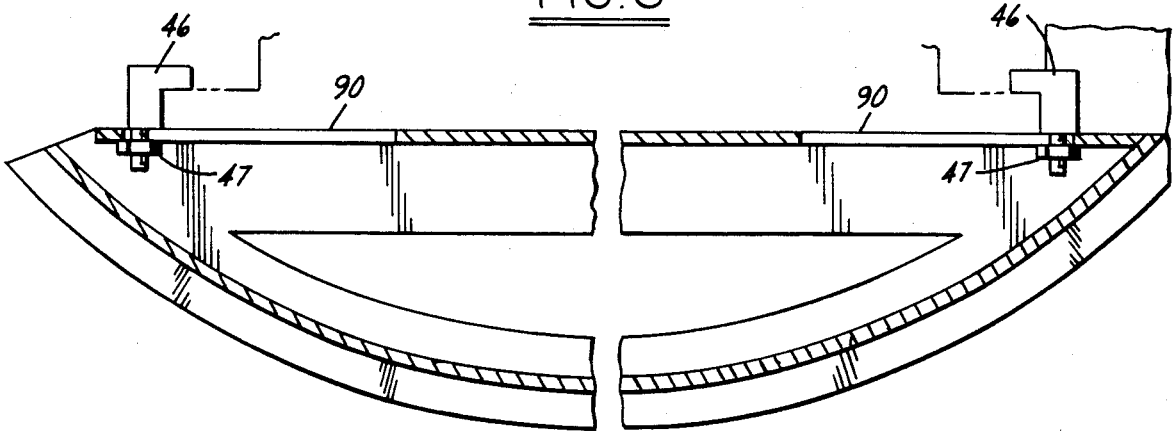
FIG. 8 is a fragmentary view showing a modification.

FIG. 8 shows a modification in which a die-supporting frame member 24 of the fixture 10 has elongated slots 90 extending lengthwise thereof through which the shanks projecting from clamps 46 extend. These slots 90 permit adjustment of the clamps 46 toward and away from each other to clamp dies of varying widths. It will be understood that all of the die-supporting frame members 24 of the fixture 10 may have the slots 90 to enable the clamps 46 carried thereby to be adjusted in a similar manner. It will also be understood that the die-supporting frame members 58 of the fixture sections 52 of fixture 12 may be similarly slotted to permit adjustment of the clamps 82.

Figure 9:
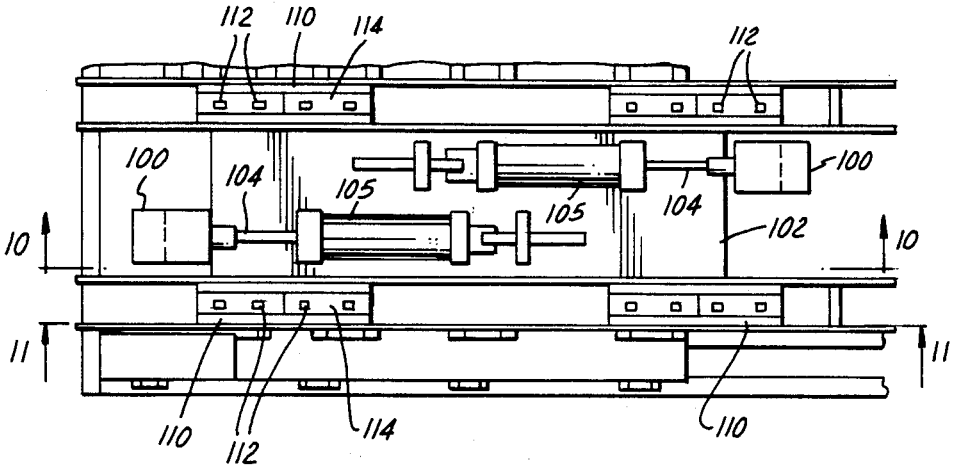
FIG. 9 is a fragmentary view showing a further modification.
Figure 10:
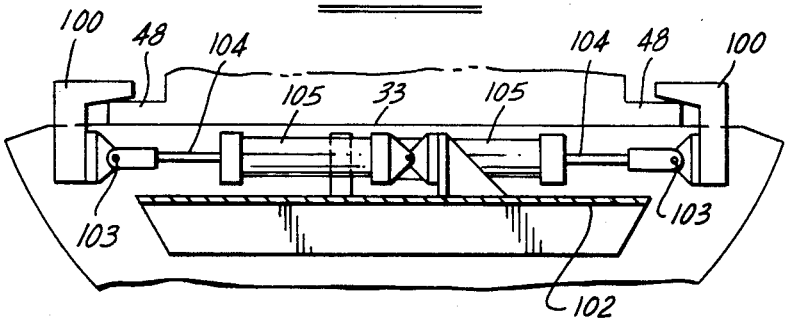
FIG. 10 is a sectional view taken on the line 10—10 in FIG. 9.
Figure 11:
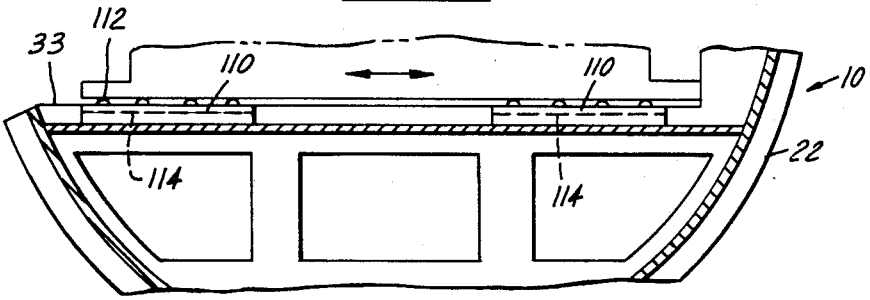
FIG. 11 is a sectional view taken on the line 11—11 in FIG. 9.

FIGS. 9–11 show a further modification of the fixture 10 in which clamps 100 are substituted for the clamps 46. The clamps 100 are located between fixture sections mounted on interconnecting structural framing 102. The clamps 100 are pivoted at 103 to rods 104 which extend from pistons (not shown) slidable within cylinders 105 connected to the structural framing 102 in a suitable manner. When pressure fluid is admitted to the rod ends the cylinders 105, the clamps are drawn toward one another to engage over the flanges 48 along the opposite sides of the die D1 to secure the die upon the die-supporting surface 33. When pressure fluid is introduced to the piston ends of the cylinders 105, the clamps 100 are moved away from the die and turn about their pivots 103 to positions disposed entirely beneath the plane of the die-supporting surface 33. The clamps 100 are capable of being manually turned back to the clamping position shown in FIG. 10 when necessary to clamp a die. It will be understood that a clamping arrangement similar to that shown in FIGS. 9 and 10 between a pair of fixture sections 20 of FIG. 10 may also be employed between the other pairs of adjacent fixture sections. It will also be understood that the clamping arrangement shown in FIGS. 9 and 10 may also be employed in connection with the fixture 12.

Mounted on the die-supporting frame members 24 of each of the fixture sections 20 of fixture 10 are support bars 110 which have rollers 112 on the top surface to serve as anti-friction members. The rollers 112 have their axes extending at right angles to the length of the die-supporting members 24 and are provided to facilitate loading a die onto the die-supporting surface 33. The rollers 112 are mounted on the support bars 110 by means permitting them to be lowered beneath the plane of the die-supporting surface 33 so that after a die has been loaded onto the fixture, the rollers may be lowered to transfer the weight of the die to the die-supporting members 24. The rollers of each support bar 110 may, for example, be mounted for free rotation on a common support rail 114 carried by the bar which may be raised or lowered as desired to raise and lower the rollers by air under pressure admitted within the bar 110 beneath the rail. These support bars 110 are air rails similar to those previously described. It will be understood that similar air rails may be provided between the other pairs of adjacent fixture sections of fixture 10. It will also be understood that similar air rails may be provided on the die-supporting members 58 of fixture 12 to facilitate unloading a die from the die-supporting surface thereof.

It should be pointed out that the dies D1 and D2 are releasably secured together by straps 120 in preparation for manipulation by the apparatus of this invention.

As previously stated, it is necessary, from time to time, to carry out inspection, cleaning, repair and/or maintenance procedures on the dies D1 and D2. Such procedures are performed on the adjacent contoured faces of the dies. In order to carry out such procedures, the dies D1 and D2 are loaded on the die-supporting surface 33 of the fixture 10 when the fixture is in the FIG. 12 position with its die-supporting surface generally horizontal. The dies are releasably secured together by the straps 120 either before or immediately after loading on the die-supporting surface 33 of fixture 10. The clamps 46 are extended over the flanges 48 of the lower die D1 and the nuts 47 tightened to secure the lower die D1 on the die-supporting surface 33. If clamps of the type shown in the modification of FIG. 8 are employed, such clamps may, of course, be adjusted toward and away from each other to accommodate dies of varying widths. If clamps of the type shown in FIGS. 9 and 10 are employed, such clamps may first be turned about their pivots 103 to positions disposed entirely beneath the plane of the die-supporting surface 33 to facilitate loading of the dies on the die-supporting surface 33 in a direction from left to right in FIG. 12. Rollers 112 of support bars 110 may be temporarily raised to facilitate loading, after which they are lowered to transfer the weight of the die to the die-supporting frame members 24 for clamping. After the dies are properly positioned on the die-supporting surface 33, the clamps may be pivoted back to the clamping position shown in FIG. 10 and then when pressure fluid is introduced to the rod ends of the cylinders 105, the clamps 100 are moved toward each other to engage over the flanges 48 of the lower die and securely clamp the lower die to the fixture.

It may be necessary or desirable to transversely adjust the fixture 10 in order to properly locate it relative to the fixture 12 so that the fixture 12 may be moved to its position adjacent the fixture 10 without interference and so that the upper die may be transferred to a correct position on the die-supporting surface 72 of the fixture 12. Transverse adjustment of the fixture 10 may be accomplished by first elevating the rollers 36 of support bars 34 to make it easier to carry out the transverse adjustment, after which the rollers 36 are lowered to transfer the weight of the mounting plate 32 back to the support bars 34.

With the die set thus securely clamped upon the die-supporting surface 33 of fixture 10, fixture 10 is then rotated to the FIG. 13 position in which its die-supporting surface 33 is generally vertical.

Thereafter the fixture 12, turned to the position in which its die-supporting surface 72 is generally vertical, is moved from the FIG. 13 position toward fixture 10 to the FIG. 14 position in which the top surface of the upper die D2 engages the die-supporting surface 72 of fixture 12. The flanges 86 along the opposite sides of the top surface of the upper die D2 are then clamped to the die-supporting surface 72 by the clamps 82 in a manner similar to that described with respect to the clamping of the lower die to the die-supporting surface 33 of fixture 10.

The straps 120 are then released to permit the dies D1 and D2 to be separated upon movement of the fixture 12 away from fixture 10 to the FIG. 15 position. The contoured faces of the dies are upright in positions convenient for inspection and cleaning. FIG. 15 shows suitable apparatus between the dies for subjecting the contoured surfaces to the action of a cleaning medium.

In order to carry out repair and maintenance procedures, the dies are most conveniently oriented with their contoured surfaces facing upwardly and for this purpose, both fixtures may be rotated to the FIG. 16 position in which their die-supporting surfaces are generally horizontal.

After the dies have been subjected to suitable inspection, cleaning, repair and/or maintenance procedures, they may be unloaded from the fixtures by releasing the clamps. If the clamps are of the type shown in FIGS. 9 and 10, they will be pivoted to positions beneath the die-supporting surfaces of the fixtures so that the lower die may be slid off the fixture 12 toward the left in FIG. 16 and the upper die slid off fixture 12 toward the right. The rollers of the air rails on the die-supporting surfaces shown in FIG. 11 may be elevated to facilitate the unloading of the dies.

We claim:

1. Manipulator apparatus for manipulating the upper and lower dies of a die set capable of being releasably secured together, comprising first and second fixtures, a first support supporting said first fixture, a second support supporting said second fixture, means mounting said first and second supports in laterally spaced relation for movement toward and away from each other, said first fixture having means providing a die-supporting surface and being in the form of a cradle rockably mounted on said first support for movement from a loading position to a transfer position, said second fixture having means providing a die-supporting surface, clamping means on said first fixture for clamping the lower die of the die set to the die-supporting surface of said first fixture when the upper and lower dies are secured together and said first fixture is in its loading position, said manipulator apparatus having power means for rocking said first fixture to its transfer position, said manipulator apparatus having second power means for relatively moving said supports toward one another when said first fixture is in its transfer position to correspondingly relatively move said fixtures toward one another for transfer of the upper die to the die-supporting surface of said second fixture, means on said second fixture for clamping the upper die to the die-supporting surface of said second fixture, said second power means being operative, when said dies are released from one another, to relatively move said supports away from each other to correspondingly relatively move said fixtures away from each other to separate said dies so that said dies may be inspected and/or cleaned.

2. Manipulator apparatus for manipulating the upper and lower dies of a die set capable of being releasably secured together, comprising first and second fixtures, a first support supporting said first fixture, a second support supporting said second fixture, means mounting said first and second supports in laterally spaced relation for movement toward and away from each other, said first fixture having means providing a die-supporting surface and being in the form of a cradle rockably mounted on said first support for movement from a loading position in which its die-supporting surface is generally horizontal to a transfer position in which its die-supporting surface faces said second fixture, said second fixture having means providing a die-supporting surface facing said first fixture, clamping means on said first fixture for clamping the lower die of the die set to the die-supporting surface of said first fixture when the upper and lower dies are secured together and said first fixture is in its loading position, said manipulator apparatus having power means for rocking said first fixture to its transfer position, said manipulator apparatus having second power means for relatively moving said supports toward one another when said first fixture is in its transfer position to correspondingly relatively move said fixtures toward one another for transfer of the upper die to the die-supporting surface of said second fixture, means on said second fixture for clamping the upper die to the die-supporting surface of said second fixture, said second power means being operative, when said dies are released from one another, to relatively move said supports away from each other to correspondingly relatively move said fixtures away from each other to separate said dies so that said dies may be inspected and/or cleaned.

3. Manipulating apparatus as defined in claim 2, wherein said second fixture is in the form of a cradle supported on said second support for rocking movement, and said manipulator apparatus has means for rocking said second fixture to a position in which its die-supporting surface is generally horizontal suitable for repairing an upper die carried thereby.

4. Manipulator apparatus as defined in claim 2, wherein said first mentioned power means is operative to rock said first fixture to a position in which its due-supporting surface is generally horizontal suitable for repairing a lower die carried thereby.

5. Manipulator apparatus as defined in claim 2, wherein one of said supports has an extension, and the other support is a carriage moveably mounted on said extension.

6. Manipulator apparatus for manipulating the upper and lower dies of a die set capable of being releasably secured together, comprising first and second fixtures, a first support supporting said first fixture, a second support supporting said second fixture, means mounting said first and second supports in laterally spaced relation for movement toward and away from each other, said first fixture having means providing a die-supporting surface and being in the form of a cradle rockably mounted on said first support for movement between a loading position in which its die-supporting surface is generally horizontal and a transfer position in which its die-supporting surface is generally upright and faces said second fixture, said second fixture having means providing a die-supporting surface and being in the form of a cradle rockably mounted on said second support for movement between a transfer position in which its die-supporting surface is generally upright and faces said first fixture and a position in which its die-supporting surface is generally horizontal, clamping means on said first fixture for clamping the lower die of the die set to the die-supporting surface of said first fixture when said upper and lower dies are secured together and said first fixture is in its loading position, said manipulator apparatus having first power means for rocking said fixtures to their transfer positions, said manipulator apparatus having second power means for relatively moving said supports toward one another when said fixtures are in their transfer positions to correspondingly relatively move said fixtures toward one another for transfer of the upper die to the die-supporting surface of said second fixture, means on said second fixture for clamping the upper die to the die-supporting surface of said second fixture, said second power means being operative, when said dies are released from one another, to relatively move said supports away from each other to correspondingly relatively move said fixtures away from each other to separate said dies so that said dies may be inspected and/or cleaned, said first power means being operative to rock said fixtures to their positions in which the die-supporting surfaces thereof are generally horizontal so that said dies may be repaired.

7. Manipulator apparatus as defined in claim 6, wherein one of said supports has an extension, and the other support is a carriage movably mounted on said extension.

8. Manipulator apparatus as defined in claim 7, wherein each fixture has laterally spaced fixture sections, the fixture sections of one fixture being offset relative to the fixture sections of the other fixture so that when said fixtures are moved toward one another the fixture sections of one fixture enter the spaces between the fixture sections of the other fixture.

9. Manipulator apparatus is defined in claim 8, including a support for one of said fixtures, said support having means for facilitating lateral adjustment of said one fixture relative to the other.

10. Manipulator apparatus as defined in claim 8, including means on said support for facilitating lateral adjustment of said first fixture.

11. Manipulator apparatus as defined in claim 8, including means on one of said fixtures to facilitate the loading or unloading of a die.

12. Manipulator apparatus as defined in claim 8, including means on each of said fixtures to facilitate the loading or unloading of a die.

* * * * *